US010132018B2

(12) United States Patent
Angelakis et al.

(10) Patent No.: US 10,132,018 B2
(45) Date of Patent: Nov. 20, 2018

(54) METHOD OF CONVERTING PHOTO IMAGE INTO REALISTIC AND CUSTOMIZED EMBROIDERY

(71) Applicant: DRAWstitch International Ltd., Limassol (CY)

(72) Inventors: Konstantinos Angelakis, Limassol (CY); Ioannis Doukakis, Limassol (CY); Miltiadis Vasileiadis, Limassol (CY)

(73) Assignee: DRAWSTITCH INTERNATIONAL LTD., Limassol (CY)

( * ) Notice: Subject to any disclaimer, the term of this patent is extended or adjusted under 35 U.S.C. 154(b) by 0 days.

(21) Appl. No.: 15/613,171

(22) Filed: Jun. 3, 2017

(65) Prior Publication Data

US 2017/0350051 A1 Dec. 7, 2017

Related U.S. Application Data

(60) Provisional application No. 62/345,001, filed on Jun. 3, 2016.

(51) Int. Cl.
*D05B 19/08* (2006.01)
*D05B 19/12* (2006.01)
*D05C 5/02* (2006.01)

(52) U.S. Cl.
CPC ..... *D05B 19/08* (2013.01); *D05B 19/12* (2013.01); *D05C 5/02* (2013.01)

(58) Field of Classification Search
CPC ..... D05B 19/02; D05B 19/04; D05B 19/08; D05B 19/12; D05B 19/14; D05B 19/16; D05C 5/02
USPC ..... 700/138
See application file for complete search history.

(56) References Cited

U.S. PATENT DOCUMENTS 5,791,271 A * 8/1998 Futamura ..... D05B 19/08 112/102.5
5,794,553 A * 8/1998 Futamura ..... D05B 19/08 112/102.5
5,839,380 A * 11/1998 Muto ..... D05B 19/06 112/102.5

(Continued)

OTHER PUBLICATIONS

Sobel operator—Wikipedia, https://en.wikipedia.org/wiki/Sobel_operator, printed Apr. 18, 2017.

(Continued)

*Primary Examiner* — Nathan Durham

(57) ABSTRACT

Software converts a photographic image into realistic and customized embroidery. Software reads photographic image, down-sampling or up-sampling so that a single pixel has a Density, One Grayscale image is created to calculate derivatives for each pixel using Sobel operator to calculate angle and magnitude and stores in a Sobel table. One Color Image is created to materialize and reduce color selection. A series of polylines are calculated to connect same-color pixels using the pixel's angle from the Sobel table. Polylines are reduced to a manageable size first by multiplying all points by Density resulting in stitch data in physical units, and by using a series of rules and formulas involving angles and magnitudes of each pixel from the Sobel table, Commands are appended to an embroidery machine to generate the final embroidery.

1 Claim, 7 Drawing Sheets

(56) References Cited

U.S. PATENT DOCUMENTS

| | | | | |
|---|---|---|---|---|
| 5,880,963 | A * | 3/1999 | Futamura | D05B 19/08 112/470.01 |
| 6,324,441 | B1 * | 11/2001 | Yamada | D05B 19/08 112/102.5 |
| 6,356,648 | B1 * | 3/2002 | Taguchi | D05B 19/08 112/470.05 |
| 6,397,120 | B1 * | 5/2002 | Goldman | D05B 19/08 112/102.5 |
| 6,407,745 | B1 * | 6/2002 | Yamada | G06T 11/60 345/593 |
| 6,804,573 | B2 * | 10/2004 | Goldman | D05B 19/08 700/131 |
| 9,200,397 | B2 * | 12/2015 | Goldman | D05C 5/02 |
| 2002/0038162 | A1 * | 3/2002 | Yamada | D05B 19/08 700/138 |
| 2007/0118245 | A1 * | 5/2007 | Goldman | D05B 19/08 700/138 |
| 2008/0103624 | A1 * | 5/2008 | Yamada | D05B 19/08 700/138 |
| 2008/0289553 | A1 * | 11/2008 | Yamada | D05B 19/08 112/470.04 |
| 2009/0138120 | A1 * | 5/2009 | Yamada | D05B 19/08 700/138 |
| 2013/0243262 | A1 * | 9/2013 | Yamada | D05C 5/02 382/111 |

OTHER PUBLICATIONS

Floyd-Steinberg dithering, Wikipedia, https://en.wikipedia.org/wiki/ printed Apr. 18, 2017.
Median cut (algorithm), Wikipeida, https://en.wikipedia.org/wiki/Median_cut, printed Apr. 18, 2017.

* cited by examiner

Fig. 2

Original image data C1 (r,g,b)

| | | | | | | | | | | | | | | |
|---|---|---|---|---|---|---|---|---|---|---|---|---|---|---|
| 255 | 255 | 255 | 192 | 192 | 192 | 128 | 128 | 128 | 96 | 96 | 96 | 0 | 0 | 0 |
| 192 | 192 | 192 | 128 | 128 | 128 | 96 | 96 | 96 | 0 | 0 | 0 | 44 | 44 | 56 |
| 128 | 128 | 128 | 96 | 96 | 96 | 0 | 0 | 0 | 32 | 32 | 32 | 55 | 66 | 85 |
| 96 | 96 | 96 | 0 | 0 | 0 | 64 | 32 | 16 | 0 | 0 | 0 | 44 | 44 | 56 |
| 0 | 0 | 0 | 64 | 32 | 16 | 96 | 64 | 32 | 64 | 32 | 16 | 0 | 0 | 0 |

FIG. 3

Grayscale Data G1

| | | | | |
|---|---|---|---|---|
| 255 | 192 | 128 | 96 | 0 |
| 192 | 128 | 96 | 0 | 45 |
| 128 | 96 | 0 | 32 | 64 |
| 96 | 0 | 39 | 0 | 45 |
| 0 | 39 | 69 | 39 | 0 |

FIG. 4

Sobel S1

| | | | | |
|---|---|---|---|---|
| ... | ... | ... | ... | ... |
| ... | dx dy M A<br>447 447 632 45 | dx dy M A<br>416 416 588 45 | dx dy M A<br>166 192 253 49 | ... |
| ... | dx dy M A<br>409 409 578 45 | dx dy M A<br>256 242 352 43 | dx dy M A<br>-83 57 100 145 | ... |
| ... | dx dy M A<br>173 173 244 45 | dx dy M A<br>64 -88 108 -54 | dx dy M A<br>-7 -19 20 -111 | ... |
| ... | ... | ... | ... | ... |

dx,dy are partial derivatives from Sobel operator, M=magnitude, a=Angle

METHOD OF CONVERTING PHOTO IMAGE INTO REALISTIC AND CUSTOMIZED EMBROIDERY

CROSS-REFERENCE TO RELATED APPLICATION

This application is a non-provisional patent application of prior provisional application No. 62/345,001 filed on Jun. 3, 2016.

FEDERALLY SPONSORED RESEARCH

Not Applicable

SEQUENCE LISTING OR PROGRAM

Not Applicable

BACKGROUND

The invention relates to a system and method for taking any photo-image and turning it into realistic and customized embroidery, with the use of software, which is then framed and delivered to the user.

Known is a web based embroidery system and method. U.S. Pat. No. 6,196,146 B1 by Goldberg teaches a web based embroidery system capable of creating and automatically fulfilling a user customized embroidery order for a selectable garment over the internet. The system includes the ability to select the garment to be customized over the internet, to selectively locate an embroidery area on that garment, to select a customized embroidery pattern over the internet to be located in the user selected embroidery area, the ability to display an embroided simulation of the user located customized embroidery pattern on the selected garment, and the ability to provide embroidery pattern controlled signals over the internet to a remotely located embroidery machine for automatically stitching the user located customized embroidery pattern on an actual garment corresponding to the selected garment based on the displayed embroidered simulation, which may be a three dimensional simulation. In addition, customized embroidery lettering can be created and may be combined with a preexisting embroidery pattern. Furthermore, on-line editing may be employed as well as individual colorizing by the user. This can be accomplished on customized web sites as well as templated websites. In addition, a system is enclosed which permits auto-digitizing of user generated images over the internet which may be automatically converted into embroidery patterns, cost estimates based thereon and, after confirmation by the user, used to automatically generate embroidery patterns on actual garments.

Unlike Goldberg, the present invention involves software that uses a special technique to generate the embroidery, which makes it truly realistic and more detailed. This present invention is available for smart phones and tablets, in addition to conventional computers.

DRAWINGS

FIG. 2 shows the image data for a Color Image (C1)

FIG. 3 shows the image data for a Grayscale Image (G1)

FIG. 4 shows a SOBEL table

DESCRIPTION

The method of converting a photographic image into realistic and customized embroidery is best exemplified within the context of a person wishing to acquire a framed embroidered picture based on a photographic image. Computer software reads a photographic image 100, pre-stored or captured onto a computer, including a mobile smart phone. The required embroidery size is determined in mm, calculated from a frame selected by the user. The computer software then generates an embroidery file. The user may preview a virtual realistic rendering of the framed embroidered picture. The embroidery file is then sent to a location where the physical embroidered picture is framed or manufactured, and then shipped to the user.

Figure 1A:
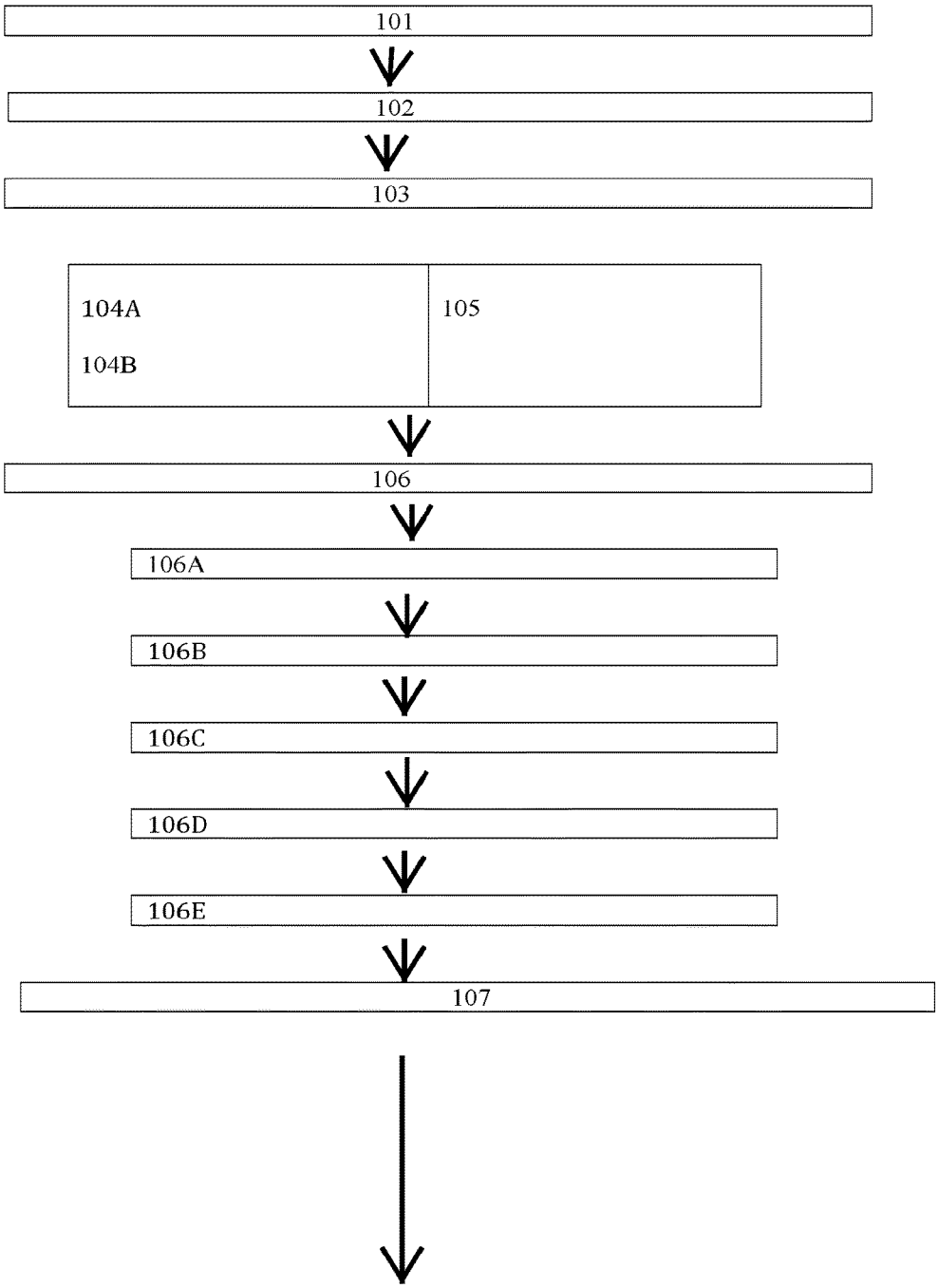
FIG. 1 is a flow chart of a software application for creating a user-customized embroidery file based on a photographic image, for use by production facilities in creating an embroidered product.
Figure 1B:
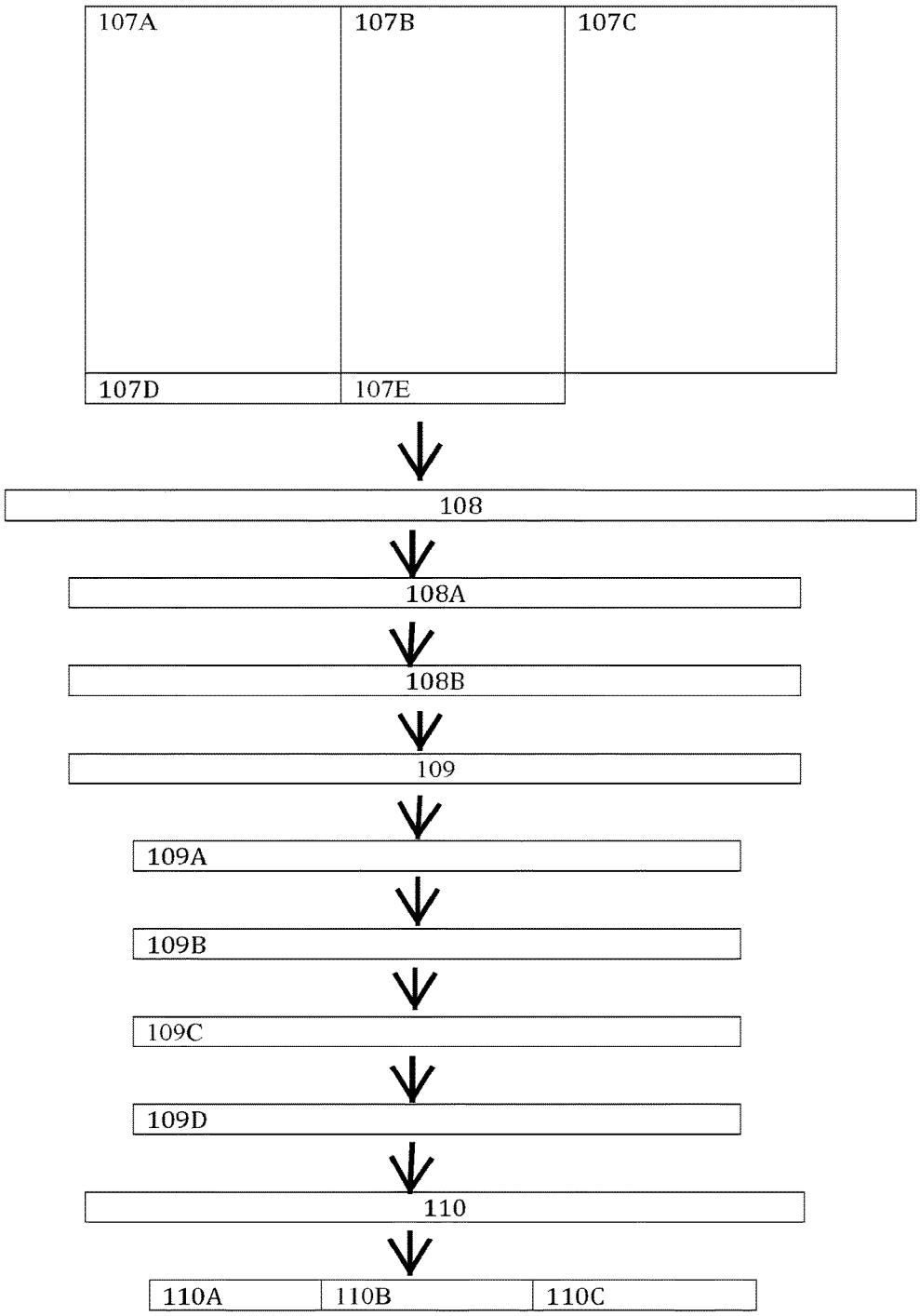

First, the photographic image is down-sampled or up-sampled (as needed) 102 so that a single pixel of the image has a predefined size in mm (called Density). The single pixel should be close to 0.6 mm, resulting in a photographic image close to 42.3 DPI. Two copies of the photographic image are stored, one as Color image (C1) and one as Grayscale image (G1) as shown in FIGS. 1 and 2, respectively 103.

Then, for each pixel of the Grayscale image (G1) the software calculates the partial derivatives (dx and dy) of the photographic image using the well known SOBEL operator 104A (https://en.wikipedia.org/wiki/Sobel_operator). From the two partial derivatives (dx and dy), the software calculates the Sobel Angle, which is a tan 2(dy,dx), and the magnitude (M), which is sqrt(dxA2+dyA2), and stores them to a table (Sobel table (S1)) 104B shown in FIG. 4. The angle calculated is perpendicular to the direction an imaginative brush would move to paint the image.

The software or user selects the number of colors to be used (usually between 10 and 15 as selected by the user) and then the software executes the color selection and reduction of the C1 image, using a median-cut algorithm (https://en.wikipedia.org/wiki/Median_cut) 105. [See "dithering" using the Floyd-Steinberg algorithm (https://en, wikipedia.orq/wiki/Floyd-Steinberg dithering).]

Figure 5:
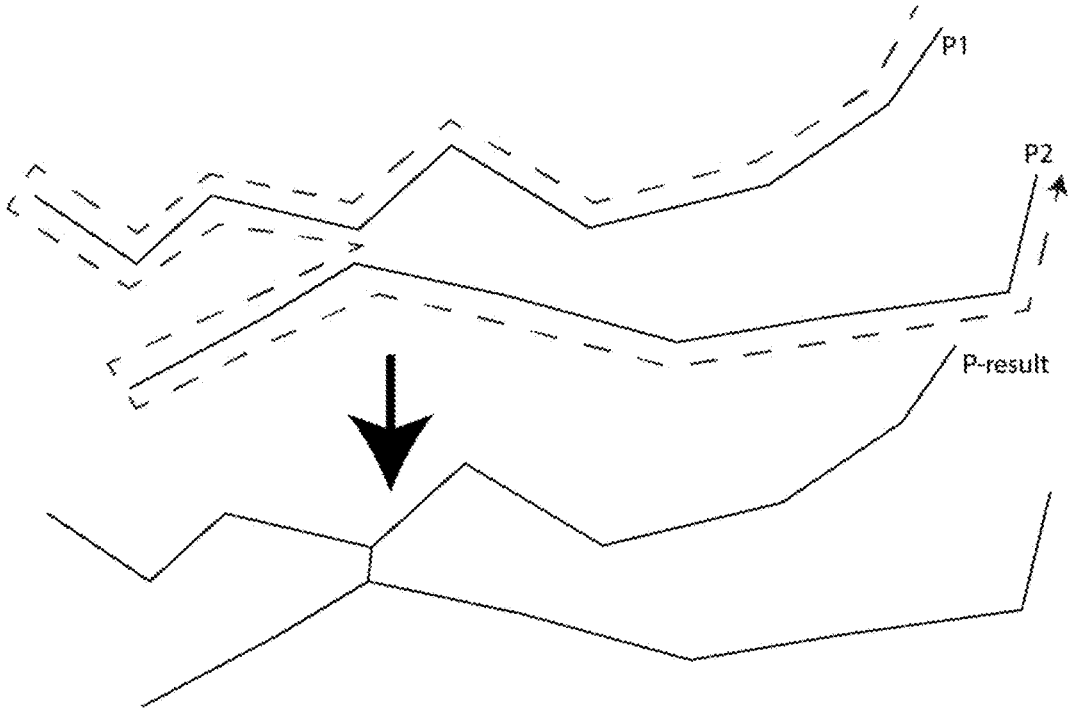
FIG. 5 illustrates the joining of two polylines where points come close.

Then, the software calculates a series of open polylines 106 that connect same-color pixels:

I. Start from an unused pixel closest to the lowest left corner of the photographic image and mark it as used (PIXEL) 106A II. Read its SOBEL Angle of the PIXEL from the Sobel table (S1) 106B III. Find a new unused pixel near the PIXEL with the same color, choosing the pixel TOWARDS the SOBEL Angle, mark it as used and add it as a point to the polyline. The nearby distance is user-defined and usually is set to 4 pixels (0.6 mm×4=2.4 mm distance) 106C IV. Continue with Step II until all closest pixels (max. 3 pixels distance) are gathered. The stored polyline is the same color as the pixels this polyline was generated 106D V. Start a new polyline from Step I for as long as unused pixels exist. 106E Next, minimize number of resulting polylines 107 to a manageable size according to the following RULES. Referring to FIG. 5, if two separate polylines of the same color (p1, p2), generated from Step 5, have a point where they come close (less than 2.5 mm), join them at this point into one polyline (P-result) 107A. Some parts of the original polylines have to be traveled twice.

If there is a very small polyline (less than 7 points) and can be joined to a similar (not same) color polyline, join it 107B. The color of the resulting polyline is the color of the largest of the two (joined) polylines. One or two-point polylines that survived Step 6 and 7 as separate entities are discarded 107E.

Group the polylines by color. Sort the color polyline groups from dark to light (if base fabric color is dark) or from light to dark (if base fabric color is light). So the polylines are put into one sequence 107C.

Figure 6:
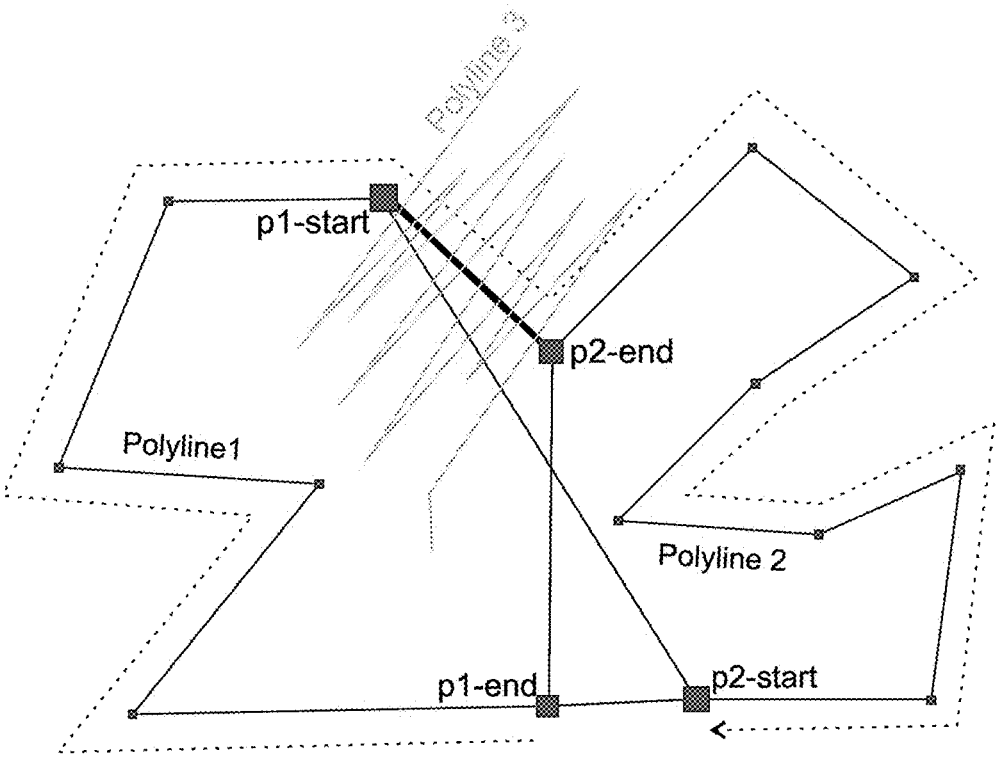
FIG. 6 illustrates the joining of pairs of polylines (Polyline 1, Polyline 2) with the same color where there is a path (p1-start→p2-start, p1-start→p2-end, p1-end→p2-start, p1-end→p2-end) that passes underneath pixels that will be covered later in a sequence.

Referring to FIG. 6, get pairs of polylines (Polyline 1, Polyline 2) with the same color and determine if there is any path (p1-start→p2-start, p1-start→p2-end, p1-end→p2-start, p1-end→p2-end) that passes underneath pixels that will be covered later in the sequence. If this is true, join the two polylines 107D. If more than one path satisfies this criteria, select the shortest (P1-start→P2-end). In other words if a polyline (e.g., Polyline 3) which will be embroidered later can cover with its thread the connection of two other polylines, it is valid to connect those two polylines (p1,p2). Different polylines have to instruct the machine to trim the thread (in the next step), a process that is costly in time.

Generate the final embroidery with an embroidery machine 108 using the following procedure.

a. All points of the polylines have their coordinates multiplied by density on output, so that the resulting stitch data will be in physical units (mm) 108A;
b. For each of the polylines: Output the first point of the polyline as-is 108B;
c. For all the other points of the polyline 109, execute the following steps;
   (I) Read the SOBEL Angle and Magnitude of the point from SOBEL table (S1) 109A;
   (II) if the magnitude is too low (less than 0.0001) output the point as is, continue with next point from (I) 109B,
   (III) Move the point a pre-defined distance (user-definable something close to 2.0 mm) perpendicular to the SOBEL Angle defined in the SOBEL table (S1). For odd points, add 90 degrees to the SOBEL angle, for even points, subtract 90 degrees from the SOBEL angle to calculate the resulting perpendicular angle 109C;
   (IV) Output the point and jump to (I) 109D.
d. Append the appropriate embroidery command to the embroidery machine 110 as follows:
   (V) If the polyline is the last add END command 110A;
   (VI) If the following polyline has the same color add the THREAD TRIM command, and jump to step (a), above 110B;
   (VII) if the following polyline has a different color add a COLOR_CHANGE command, and jump to step (a), above 110C.

With regard to c, above, embroidery machines have a list of commands to operate on. The list is generated by the computer software and can be sent via usb-stick, floppy disk, paper-tape or directly via cable and now via Wi-Fi. This list of commands is a series of 2-D coordinates for the machine to move and do stitching. Some of these commands contain extra information for the machine and are usually called "special functions." Different companies call them with different names. The most usual special functions are:

THREAD TRIM command instructs the machine to cut the thread. If the machine has automatic thread trimmer, will cut the thread, otherwise will instruct the operator to do so.

COLOR_CHANGE command instructs the machine to change thread color. If the machine has multicolor it will cut the previous thread and automatically switch to a new color, otherwise instruct the operator to change the thread.

END command signals the end of the command list to the machine and finish.

While the invention perceives the use of the embroidered image on a picture frame, it should be noted that the embroidered image can also appear on non-traditional picture frames, such as pillows, blankets, walls, clothing, and any item on which a photographic image may appear on textile. By this definition, a "frame" can be a pillow, blanket, wall, or shirt.

The following steps are executed in carrying out the method. First, the software reads a photographic image. Second, the image is down-sampled or up-sampled so that a single pixel has a density of approximately 0.06 mm. Third, the software generates two copies of the photographic image, Grayscale (G1) and Color Image (C1). Partial derivatives (dx and dy) are calculated for each pixel using SOBEL operator for the Grayscale (G1) image. From the two partial derivatives (dx and dy), the software calculates a SOBEL angle [(a tan 2(dy,dx)] and Magnitude [sqrt(dx2, dy2)] and stores it in a SOBEL table. The number of colors is reduced to 10-15 and color selection and reduction is executed.

Fourth, a series of open polylines that connect the same-color pixels is calculated. Starting from an unused pixel closest to the lower left corner of the photographic image, it is marked as "used" ("the PIXEL"). The PIXEL'S angle is read from the SOBEL table. A new unused pixel near the PIXEL is found with the same color by favoring the pixel towards the SOBEL angle, and is marked as "used" and added as a point to a polyline, and that step is repeated until all the closest pixels are gathered, resulting in a stored polyline representing the same color as the gathered pixels. A new polyline is started from a new unused Pixel and the process repeated for as long as unused pixels exist.

Fifth, the number of resulting poly lines is minimized according to the following rules: If two separate polylines of the same color (p1, p2) have a point where they come close (less than 2.5 mm), join them at said point into one polyline (P-result). If there is a very small polyline that has less than 7 points, join said very small polyline to any similar color polyline, so that the color of the resulting polyline remains the color of the largest of the two (joined) polylines. Group the polylines by color and place the color polyline groups from dark to light, if the base fabric color is dark, or from light to dark, if the base fabric color is light, so that the color polyline groups are put into one sequence. Get pairs of polylines with the same color and determine if there is any path that passes underneath pixels that will be covered later in the sequence; if this is true, join the two polylines at such path, where there is more than one path. Discard polylines with only one or two points.

Sixth, to generate the final embroidery with an embroidery machine, multiply all points of the polylines by Density, so that the resulting stitch data is in physical units (mm).

for each of the polylines, output the first point of the polyline as-is to the embroidery machine. For all other points of the polyline, execute the following steps: a) Read the SOBEL angle and the magnitude of the point from the SOBEL table. b) If the magnitude is less than 0.0001, output the point as-is, then continue with the next point. c) Move the point to a pre-defined distance close to 2.0 mm, perpendicular to the SOBEL angle defined in the SOBEL table; for odd points, add 90 degrees to the SOBEL angle, for even points, subtract 90 degrees from the SOBEL angle to calculate the resulting perpendicular angle. d) Output the point to the embroidery machine and return to step a).

Seventh, append embroidery commands to the embroidery machine as follows: If the poly line is the last, the software signals an end of a command list to the embroidery machine and finishes. If the following polyline has the same color, the software instructs the embroidery machine or a user to cut the thread and jump to the sixth step above. If the following polyline has a different color, the software instructs the embroidery machine or user to change the thread color and jump to the sixth step above.

What is claimed:

1. A method of converting a photographic image into realistic and customized embroidery using software, the method comprising:

a) computer software reading a photographic image and calculating the size of an embroidered product based on a frame size selected by a user;

b) down-sampling or up-sampling said photographic image so that a single pixel of said photographic image has a predefined size of 0.6 mm, defined as density, resulting in a photographic image approximately 42.3 DPI;

c) storing two copies of said image, one as a color image and one as a grayscale image;

d) calculating for each pixel of the grayscale image partial derivatives dx and dy of said photographic image using a SOBEL operator; and from the two partial derivatives dx and dy, calculating a SOBEL angle, which is arctangent of two dy,dx and a magnitude, which is square root of dx square plus dy square, and storing them to a SOBEL table;

e) selecting a number of colors to be used and then executing the color selection and reduction of the color image, using a median-cut algorithm;

f) calculating a series of open polylines that connect same-color pixels by:

i. starting from a first unused pixel adjacent a lowest left corner of the photographic image and marking it as a used PIXEL;

ii. reading the SOBEL angle of the used PIXEL from the SOBEL table;

iii. finding a second unused pixel near the used PIXEL of like color, choosing the PIXEL towards the SOBEL angle, marking it as used and adding it as a point to the polyline;

iv. repeating step ii until all pixels having a maximum of 3 pixels distance are gathered, resulting in a stored polyline that is of like color as the pixels from which the polyline was generated;

v. starting a new polyline until all pixels are used;

g) minimizing the number of polylines to a manageable size by:

i. joining two separate polylines of the same color (p1, p2) into one polyline at a point where they are less than 2.5 mm apart;

ii. joining a polyline of less than 7 points to any polyline of the same color, such that the color of the resulting polyline remains the color of the largest of the two joined polylines;

iii. discarding polylines with fewer than two points;

iv. grouping the polylines by color and arranging the color polyline groups from dark to light if a base fabric color is dark, and from light to dark if the base fabric color is light, such that the color polyline groups are put into one sequence;

v. determining if pairs of polylines with the same color; determining if there is any path that passes underneath pixels that will be covered later in the sequence; joining the two polylines at such path; and joining the polylines at the shortest path where more than one path has the same color; and h) generating the embroidery using an embroidery machine by:

i. multiplying the coordinates of all points of the polylines by the Density on output, such that the resulting stitch data is in physical units;

ii. outputting for each of the polylines the first point of the polyline to an embroidery machine;

iii. executing the following steps for all other points of the polyline:

a. reading the SOBEL Angle and a magnitude of the point from the SOBEL table;

b. outputting the point if the magnitude is less than 0.0001;

c. moving the point to a pre-defined distance to approximately 2.0 mm, perpendicular to the SOBEL angle defined in the SOBEL table; adding 90 degrees to the SOBEL angle for odd points, and subtracting 90 degrees from the SOBEL angle for even points to calculate the resulting perpendicular angle;

d. outputting the point to the embroidery machine; and iv. appending embroidery commands to the embroidery machine by:

a. signaling an end of a command list to the embroidery machine if the polyline is the last;

b. instructing the embroidery machine to cut a thread if the following polyline has the same color; and c. instructing the embroidery machine to change a thread color if the following polyline has a different color.

* * * * *